US010098429B2

(12) United States Patent
Krainz

(10) Patent No.: US 10,098,429 B2
(45) Date of Patent: Oct. 16, 2018

(54) MULTI-FOLDING JEWELRY BOX

(71) Applicant: Roland Krainz, Brookfield, CT (US)

(72) Inventor: Roland Krainz, Brookfield, CT (US)

( * ) Notice: Subject to any disclaimer, the term of this patent is extended or adjusted under 35 U.S.C. 154(b) by 0 days.

(21) Appl. No.: 15/398,438

(22) Filed: Jan. 4, 2017

(65) Prior Publication Data

US 2018/0184774 A1 Jul. 5, 2018

(51) Int. Cl.

| | |
|---|---|
| ***A45C 11/04*** | (2006.01) |
| ***A45C 11/16*** | (2006.01) |
| ***A45C 13/00*** | (2006.01) |
| ***B65D 25/10*** | (2006.01) |
| ***B65D 43/22*** | (2006.01) |

(52) U.S. Cl.

CPC ..... *A45C 11/16* (2013.01); *A45C 13/005* (2013.01); *B65D 25/10* (2013.01); *B65D 43/22* (2013.01)

(58) Field of Classification Search

CPC ..... A45C 11/46; A45C 13/005; B65D 25/10; B65D 43/22

USPC ..... 206/6.1, 566, 563, 562, 559, 564, 565, 206/751, 752, 754, 756, 757, 759, 760, 206/768, 745, 747, 748, 749, 784, 750, 206/525.1

See application file for complete search history.

(56) References Cited

U.S. PATENT DOCUMENTS 1,240,671 A * 9/1917 Catala ..... A45C 11/16 206/6.1
1,486,629 A * 3/1924 Buchsbaum ..... A45C 11/16 206/37
1,960,073 A * 5/1934 Warner ..... A45C 11/16 206/303
D237,590 S 11/1975 Scantlin
3,987,894 A * 10/1976 Bidegain ..... B65D 5/5038 206/754
D249,240 S 9/1978 Klitzner
4,323,153 A * 4/1982 Courtin ..... A45C 11/24 206/755

(Continued)

FOREIGN PATENT DOCUMENTS

| | | |
|---|---|---|
| CH | 699272 B1 | 2/2010 |
| DE | 1445832 U | 3/1938 |

(Continued)

OTHER PUBLICATIONS

U.S. Notice of Allowance, U.S. Appl. No. 29/589,763, 9 pages, dated Nov. 14, 2017.

(Continued)

*Primary Examiner* — Jacob K Ackun
*Assistant Examiner* — Jenine Pagan
(74) *Attorney, Agent, or Firm* — Thompson Hine LLP

(57) ABSTRACT

A jewelry box for holding jewelry is disclosed that has an elongate member having a first end and a second end, an inner surface and an outer surface, and that is foldable between an open position and a closed position, where the closed position is a box. A jewelry-receiving member protrudes from the inner surface of the elongate member for movement therewith and defines a receptacle to receive a piece of jewelry. The receptacle, in the open position, is oriented generally perpendicular to the inner surface of the elongate member and, in the closed position, after rotation of the jewelry-receiving member of about 90 degrees, is oriented generally parallel to the inner surface of the elongate member.

12 Claims, 5 Drawing Sheets

(56) References Cited

U.S. PATENT DOCUMENTS

| | | | | | |
|---|---|---|---|---|---|
| 4,767,000 | A | | 8/1988 | Ovadia | |
| 5,325,960 | A | * | 7/1994 | Sims | B65D 5/4204 206/301 |
| D376,476 | S | | 12/1996 | Tepen | |
| 5,810,162 | A | * | 9/1998 | Au | A45C 11/16 16/334 |
| D400,708 | S | | 11/1998 | Srinaul | |
| 5,979,661 | A | * | 11/1999 | Sherman | A47F 7/03 206/566 |
| D457,315 | S | | 5/2002 | Wolf | |
| D461,637 | S | | 8/2002 | Kaplan | |
| D483,941 | S | | 12/2003 | Fassett | |
| D493,107 | S | | 7/2004 | Bergne | |
| D509,133 | S | | 9/2005 | Au | |
| D513,176 | S | | 12/2005 | Au | |
| D606,859 | S | | 12/2009 | Stewart | |
| 7,779,996 | B2 | | 8/2010 | Elias | |
| 9,375,066 | B1 | * | 6/2016 | Velazquez | A45C 11/16 |
| 9,549,600 | B2 | | 1/2017 | Juillet | |
| 2007/0102307 | A1 | | 5/2007 | Shen | |
| 2010/0181227 | A1 | | 7/2010 | Tolkowsky | |
| 2014/0318992 | A1 | | 10/2014 | Morelli Carullo | |
| 2016/0316874 | A1 | | 11/2016 | Mandelbaum | |

FOREIGN PATENT DOCUMENTS

| | | | |
|---|---|---|---|
| EP | 1733972 | A2 | 12/2006 |
| EP | 3 018 063 | | 5/2016 |

OTHER PUBLICATIONS

U.S. Notice of Allowance, U.S. Appl. No. 29/589,765, 9 pages, dated Nov. 15, 2017.

* cited by examiner

MULTI-FOLDING JEWELRY BOX

TECHNICAL FIELD

The present application relates generally to jewelry boxes and more particularly to a multi-folding holder that displays a jewelry ring and is foldable into a pocket-sized box.

BACKGROUND

Smaller jewelry products such as rings, earrings, and cufflinks may require proper protection while also requiring packaging that is compact.

Usual packaging for jewelry products involves multiple components that may be expensive to manufacture or otherwise burdensome to store. Simpler, less expensive boxes are desirable.

Jewelry products may also need to be showcased in a display area so as to attract customers to buy or otherwise to allow customers to learn of the product from the display area. Vendors, in this case, usually have to resort to having separate areas for the product display and the packaging area. This may be undesirable when the vendor wishes to showcase the package along with the jewelry product. Thus, there is a need for a packaging that can also serve a display function.

Jewelry is often purchased as a gift, and, in the case of a diamond ring, for a marriage proposal. In the latter case, the person proposing may wish to have smaller packaging, preferably only barely covering the ring so that the person may hide the ring in a pocket, thereby aiding in the surprise when proposing.

Thus, there is a need for improved jewelry boxes, especially smaller boxes that also display the jewelry.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present system.

SUMMARY

Figure 1:
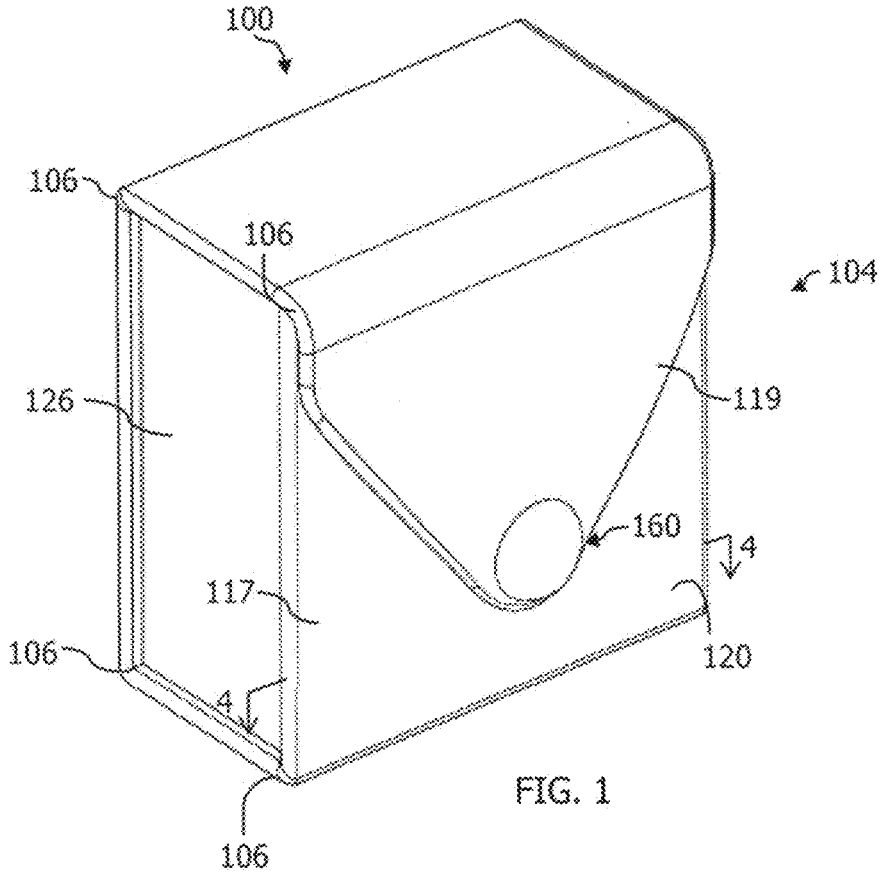
FIG. 1 is a front perspective view of a first embodiment of a jewelry box in a closed position.

A jewelry box for holding jewelry is disclosed that has an elongate member having a first end and a second end, an inner surface and an outer surface, and that is foldable between an open position and a closed position, where the closed position is a box. A jewelry-receiving member protrudes from the inner surface of the elongate member for movement therewith and defines a receptacle to receive a piece of jewelry. The receptacle, in the open position, is oriented generally perpendicular to the inner surface of the elongate member and, in the closed position, after rotation of the jewelry-receiving member of about 90 degrees, is oriented generally parallel to the inner surface of the elongate member.

The jewelry box, in all aspects, may have a pair of opposing walls extending from the elongate member, which are spaced apart a distance from one another and oriented relative to the jewelry-receiving member to have or receive the jewelry-receiving member therebetween in the closed position. In all aspects, the jewelry box may optionally have a connecting wall protruding from the inner surface of the elongate member and connecting the opposing walls to one another to define a chamber having an open end adjacent to the jewelry-receiving member. The chamber receives the jewelry-receiving member therein in the closed position.

In all aspects, the elongate member has a plurality of folds oriented transverse to a central longitudinal axis of the elongate member. In one embodiment, a closure portion of the second end of the elongate member, in the closed position, is seated on a top surface of the pair of opposing walls, and, in another embodiment, a closure portion of the first end of the elongate member, in the closed position, is seated on a top surface of the pair of opposing walls.

In one embodiment, the first end of the elongate member has a first fold and a second fold, and the second end of the elongate member has a third fold and a fourth fold. The first fold is proximate a first end of each of the pair of opposing walls, and the second fold is spaced a distance apart from the first fold at a position at which a portion of the first end is foldable onto a portion of the second end or onto a top surface of the pair of opposing walls. The third fold is proximate a second end of each of the pair of opposing walls, and the fourth fold is spaced a distance apart from the third fold, thereby defining a first side portion of the second end that in the closed position closes an opening between the second ends of the pair of opposing walls.

In all aspects, the first end and the second end of the elongate member, in particular, the closure portions of each, are releasably mateable to one another in the closed position. The first end has a first fastening member and the second end has a second fastening member positioned to mate in the closed position. Whichever of the closure portions of the first end and the second end forms the outermost surface of the box may have a polygonal-shape.

In a second embodiment, the first end of the elongate member has a first fold, a second fold, and a third fold, and the second end of the elongate member has a fourth fold. Here, the first fold is adjacent to a first end of each of the opposing walls, the second fold is spaced a distance apart from the first fold, and the third fold is spaced a distance apart from the second fold at positions aligned with opposing corner planes of the top surface of the pair of opposing walls. The fourth fold is adjacent to a second end of each of the pair of opposing walls. Of this second embodiment, in one variation, the jewelry-receiving member is between the first fold and the second fold, and in a second variation, the jewelry-receiving member is adjacent to the fourth fold.

DETAILED DESCRIPTION

The following detailed description will illustrate the general principles of the invention, examples of which are additionally illustrated in the accompanying drawings. In the drawings, like reference numbers indicate identical or functionally similar elements.

Figure 2:
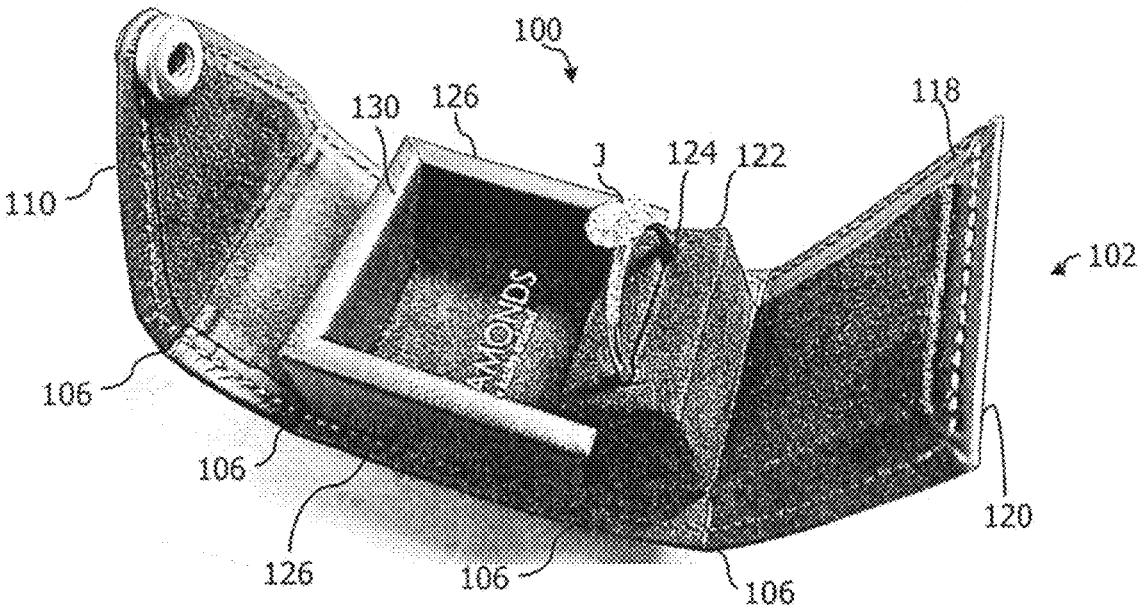
FIG. 2 is a partially folded, perspective view of the jewelry box of FIG. 1.
Figure 3:
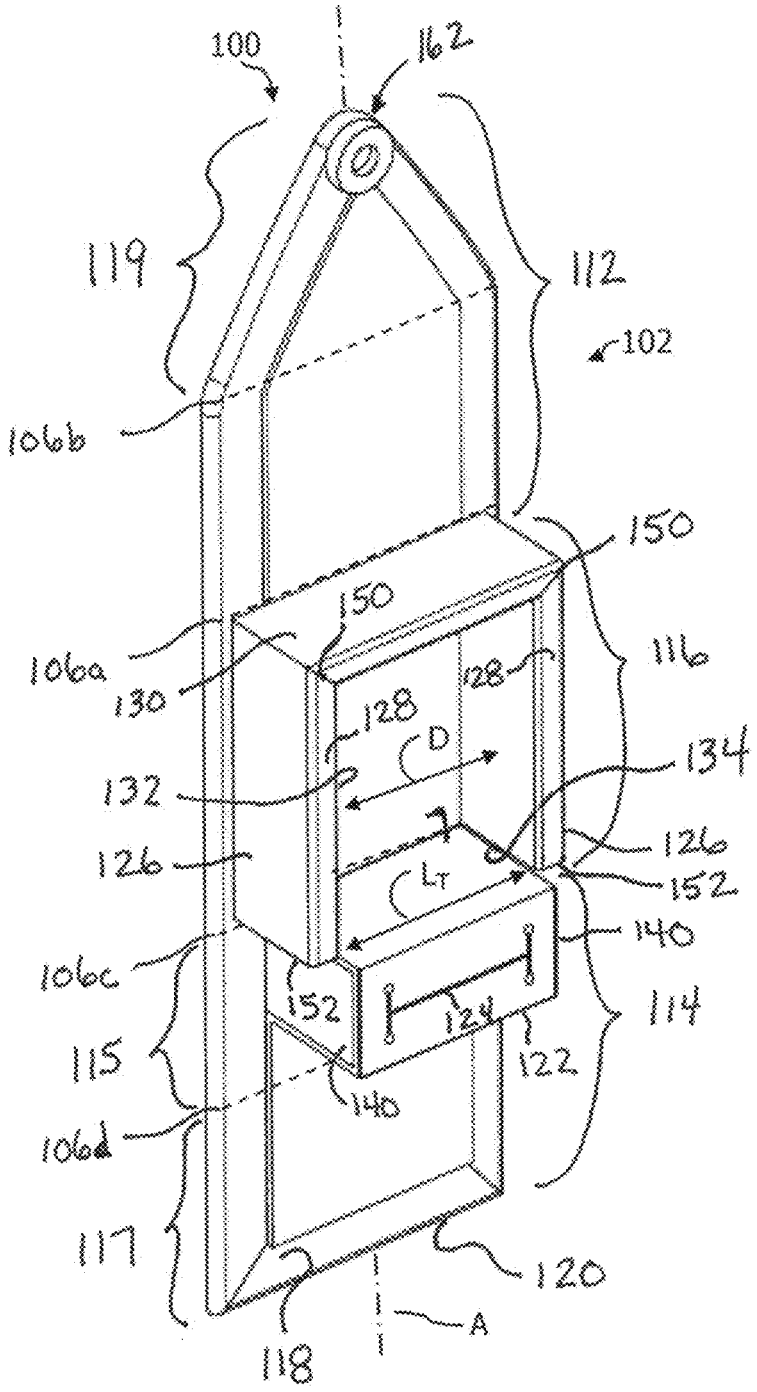
FIG. 3 is a top perspective view of the jewelry box of FIG. 1 in an open position.

Referring to FIGS. 1-3, a jewelry box, generally identified by reference number 100, is shown that transitions from a generally flat open position 102 (FIGS. 2 and 3) through a plurality of folds 106, oriented transverse to a central longitudinal axis A of the elongate member, to a closed position 104 (FIG. 1) in the shape of a box. The elongate member 110 is made up of a material that is foldable so as to form the box 100, has a first end 112 and a second end 114 separated by a seat portion 116, and has an inner surface 118 and an outer surface 120. A jewelry-receiving member 122 protrudes from the inner surface 118 of the elongate member 110 for movement therewith and defines a receptacle 124 shaped to receive a piece of jewelry J, such as a ring (see FIG. 2). The receptacle 124 may be any shape and configuration necessary to securely hold the piece of jewelry J. The receptacle 124, in the open position 102, is oriented generally perpendicular to the inner surface 118 of the elongate member 110 and, in the closed position 104, after rotation of the jewelry-receiving member 122 of about 90 degrees to a seated position against the seat portion 116 of the elongate member 110, is oriented generally parallel to the inner surface 118 of the elongate member 110.

When the jewelry J is a ring, such as an engagement ring, the elongate member 110 has a length of about 100 mm-300 mm and a width of about 30 mm-80 mm. In one embodiment, the elongate member 110 is 140 mm long and 40 mm wide.

Figure 5:
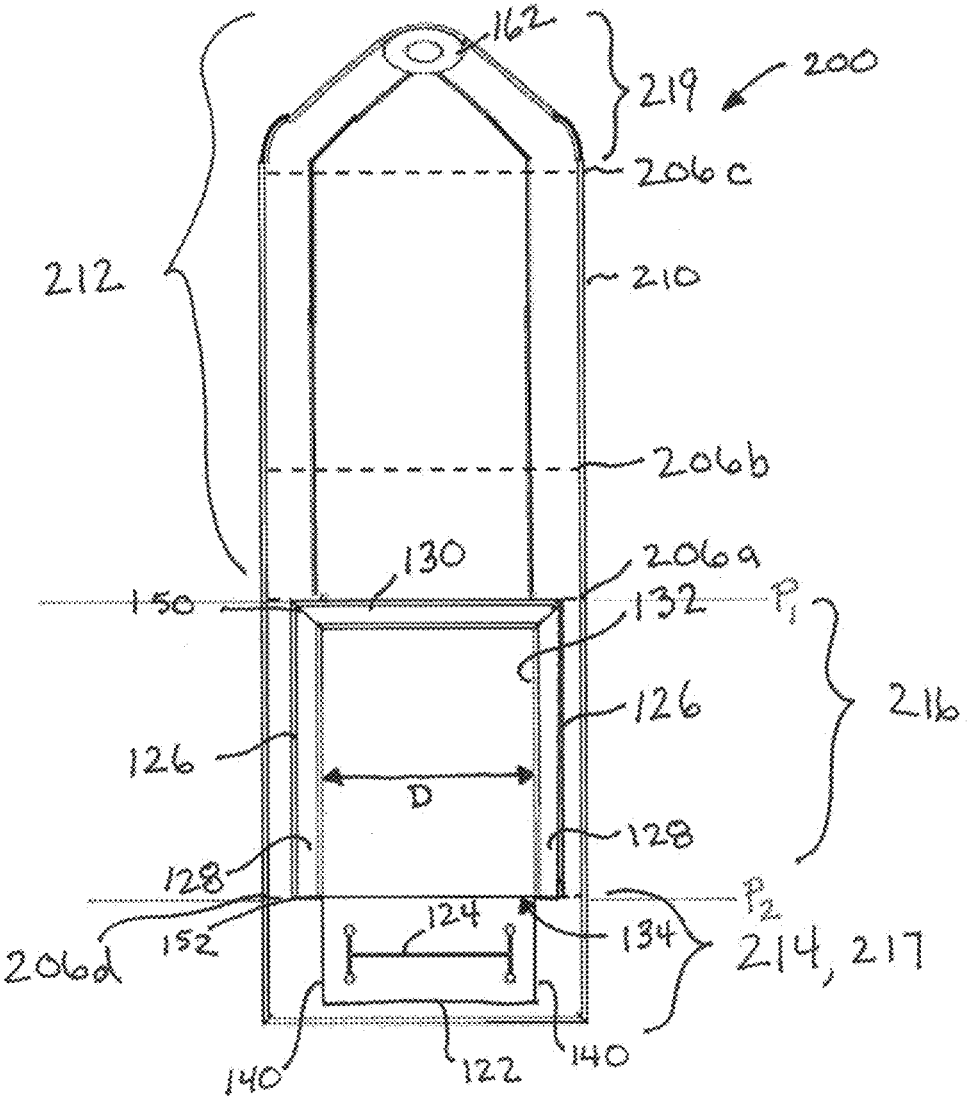
FIG. 5 is a top plan view of a second embodiment of a jewelry box in an open position, closeable similarly to the jewelry box of FIG. 1.
Figure 6:
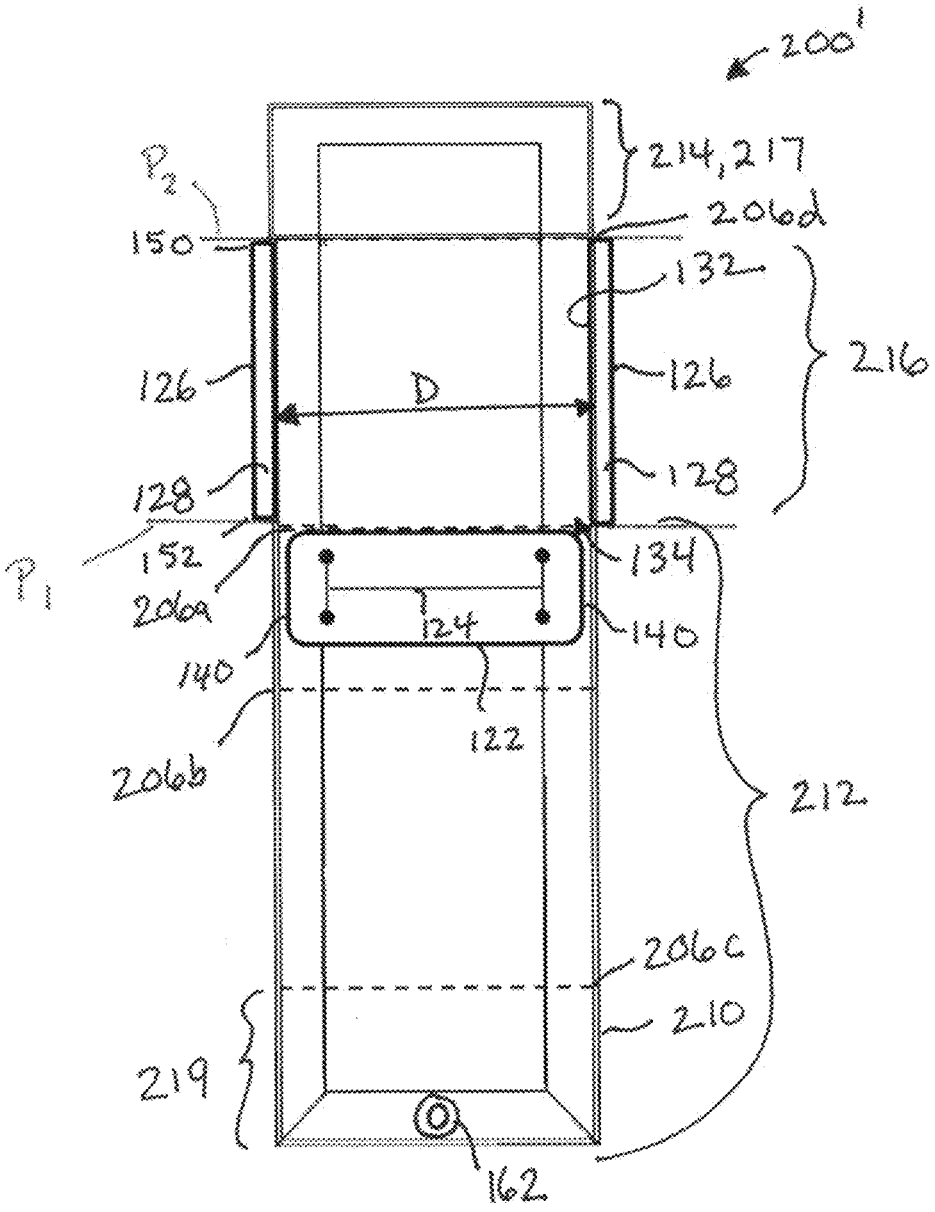
FIG. 6 is a top plan view of a third embodiment of a jewelry box in an open position, closeable similarly to the jewelry box of FIG. 1.
Figure 7:
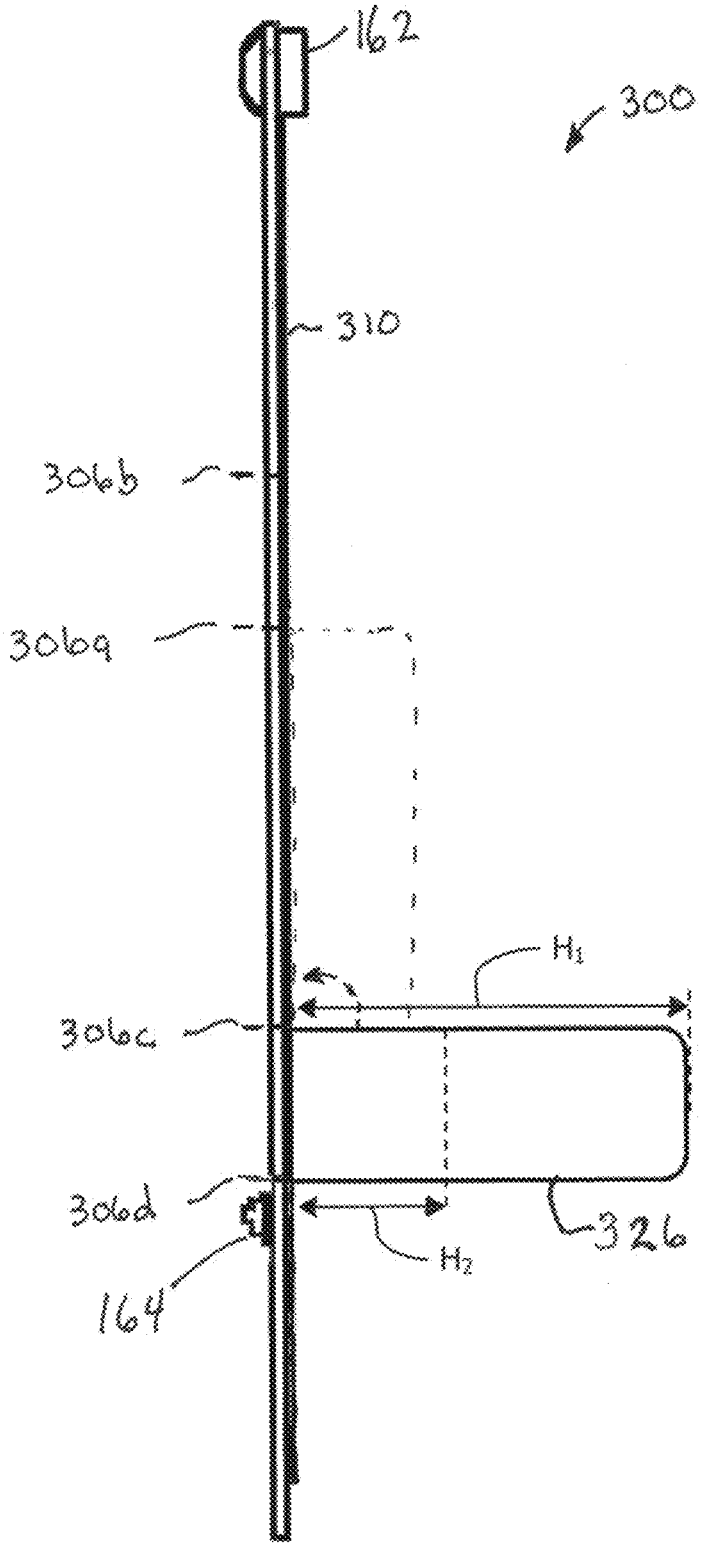
FIG. 7 is a side plan view of a fourth embodiment of a jewelry box in an open position, closeable similarly to the jewelry box of FIG. 1.

The elongate member 110 may include a pair of opposing walls 126 extending from the elongate member 110, 210 in the seated portion 116 as illustrated in FIGS. 1-6 or the portion thereof that has the jewelry-receiving member 122, for example, as illustrated in FIG. 7. The pair of opposing walls 126 is spaced apart a distance D that is transverse to the longitudinal axis A. In FIGS. 1-6, the distance D between the opposing walls 126 is greater than the transverse length $L_T$ of the jewelry-receiving member 122 such that the jewelry-receiving member 122 is receivable between the opposing walls 126 after movement with the elongate member 110 to the closed position 104 of FIG. 1.

In contrast, in the embodiment of FIG. 7, the opposing walls 326 of the jewelry box 300 are still spaced apart a distance D that is greater than the transverse length $L_T$ of the jewelry-receiving member 122, but the opposing walls 326 are adjacent to opposing ends 140 of the jewelry-receiving member 122 and are movable with the jewelry-receiving member 122 and the elongate member 310 through the about 90 degrees of rotation from the open position to the closed position through the plurality of folds 306*a*-306*d*. Here, the opposing walls 326 may be connected to the opposing ends 140 of the jewelry-receiving member 122 and, typically, have a height $H_1$ that is greater than the height $H_2$ of the jewelry-receiving member, thereby protecting a piece of jewelry after the elongate member 310 is folded to the closed position.

Figure 4:
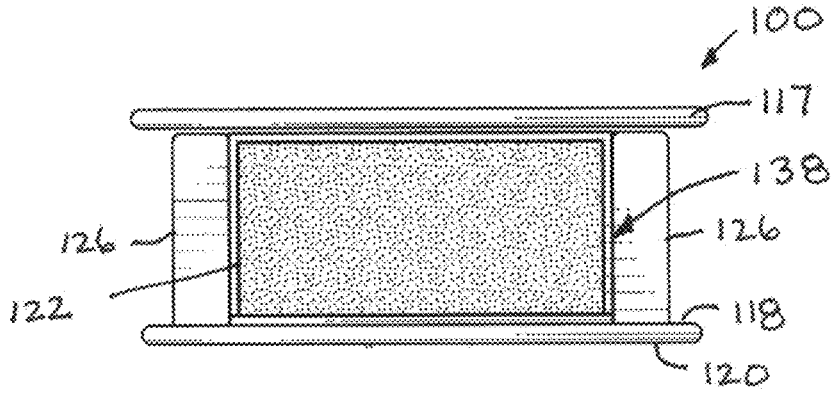
FIG. 4 is a transverse cross-section through the jewelry box of FIG. 1 along line 4-4.

Referring to the embodiments of FIGS. 1-5, the elongate member 110 may include a connecting wall 130, but this wall is not required as illustrated in FIGS. 6 and 7. The connecting wall 130 connects the opposing walls 126 to one another at their respective first ends 150 to define a chamber 132 that has an open end 134 at the second ends 1562 thereof and adjacent to the jewelry-receiving member 122. The chamber 132 is shaped to receive the jewelry-receiving member 122 with a piece of jewelry seated in its receptacle 124, when the elongate member 110 is folded to the closed position 104, and seated therein as shown in FIG. 4.

In the embodiment of FIGS. 1-4, the first end 112 of the elongate member 110 has a first fold 106*a* and a second fold 106*b*, and the second end 114 of the elongate member 110 has a third fold 106*c* and a fourth fold 106*d*. The first fold 106*a* is proximate a first end 150 of each of the pair of opposing walls 126, and the second fold 106*b* is spaced a distance apart from the first fold 106*a* at a position at which a first closure portion 119 of the first end 112 is foldable onto a second closure portion 117 of the second end 114 or onto a top surface 128 of the pair of opposing walls 126. The third fold 106*c* is proximate a second end 114 of each of the pair of opposing walls 126, and the fourth fold 106*d* is spaced a distance apart from the third fold 106*c*, thereby defining a first side portion 115 of the second end 112 that in the closed position 104 closes the opening 134 between the second ends 152 of the pair of opposing walls 126.

As illustrated in FIG. 1, in the closed position 104, a second closure portion 117 of the second end 114 of the elongate member 110 is seated on the top surface 128 of the pair of opposing walls 126, and a first closure portion 119 of the first end 112 of the elongate member 110 is seated on top of the second closure portion 117. In an alternate embodiment, the opposite orientation of these first and second closure portions 117, 119 is also possible, with the second closure portion 117 on top of the first closure portion 119. The first and second closure portions 117, 119 are releasably fastened to one another by a fastening system 160. The fastening system 160 is any system suitable of releasably fastening the elongate member 110 in the box 100 configuration, such as, but not limited to a hook and loop fastening system, a snap fastening system, a magnetic fastening system, a ribbon tying system, a buckle fastening system, and a button fastening system. The first closure portion 119 has a first fastening member 162 and the second closure portion 117 has a second fastening member 164 (best shown in FIG. 7) that are releasably mateable to one another to hold the elongate member 110 in the closed position 104 of FIG. 1. In the illustrated embodiments, the fastening system 160 is a snap fastening system, but is not limited thereto as noted above.

As seen in FIGS. 1-7, whichever of closure portions 117, 119, 217, 219 of the first end 112, 212, 312 and the second end 114, 214, 314 forms the outermost surface of the box may have a polygonal-shape. As illustrated in FIG. 1, a triangular-shaped portion, and, as illustrated in FIG. 6, a rectangular-shaped portion are shown. In alternate embodiments, the portion forming the outermost closure portion may be curved, for example as tilde, a sign wave, half circle, etc. The shape thereof is unlimited and may even be the shape of a company logo.

Referring now to FIGS. 5-6, jewelry boxes 200 and 200', respectively, are disclosed that have any of the configurations of the jewelry-receiving member 122 and walls 126, 130 discussed above, but in different positions along the length of the elongate member 110. The position of the jewelry-receiving member and walls 126, 130 (if present) changes the number of folds on the first and second ends 212, 214 of the elongate member 210 as follows: the first end 212 of the elongate member has a first fold 206*a*, a second fold 206*b*, and a third fold 206*c*, and the second end 214 of the elongate member 210 has a fourth fold 206*d*. The third fold 206*c* is adjacent to a first end 150 of each of the opposing walls 126, the second fold 206*b* is spaced a distance apart from the third fold 206*c*, and the first fold 206*a* is spaced a distance apart from the second fold 206*b* at positions aligned with opposing corner planes $P_1$, $P_2$ of the top surface 128 of the pair of opposing walls 126. The fourth fold 206*d* is adjacent to a second end 152 of each of the pair of opposing walls 126.

The difference between the elongate members 210 of FIGS. 5 and 6 is the position of the jewelry-receiving member 122 relative to the position of the folds 206*a*-206*d*. In FIG. 5, the jewelry-receiving member 222 is adjacent to the fourth fold 206*d*, and in FIG. 6, it is between the first fold 206*a* and the second fold 206*b*. In both of these embodiments, the opposing walls 126 may extend from the seat portion 216 of the elongate member 210 or, as illustrated in FIG. 7, the opposing walls 126 may be adjacent to the jewelry receiving member and moveable with the portion of the elongate member 210 having the jewelry-receiving member.

Although various aspects of the multi-folding jewelry box have been shown and described, modifications may become apparent to those skilled in the art upon reading the specification. The present application includes such modifications and is limited only by the scope of the claims.

What is claimed is:

1. A jewelry box for holding jewelry comprising:

an elongate member having a first end and a second end, an inner surface and an outer surface, and being foldable between an open position and a closed position, the closed position being a box;

a jewelry-receiving member protruding from the inner surface of the elongate member for movement therewith, the jewelry-receiving member defining a receptacle to receive a piece of jewelry; and a pair of opposing walls extending from the elongate member, the pair of opposing walls being spaced apart a distance from one another and oriented relative to the jewelry-receiving member to have or receive the jewelry-receiving member therebetween in the closed position;

wherein:

the receptacle, in the open position, is oriented generally perpendicular to the inner surface of the elongate member and, in the closed position, after rotation of the jewelry-receiving member of about 90 degrees, the receptacle is oriented generally parallel to the inner surface of the elongate member; and the first end of the elongate member has a first fold and a second fold, and the second end of the elongate member has a third fold and a fourth fold, wherein the first fold, second fold, third fold, and fourth fold are oriented transverse to a central longitudinal axis of the elongate member.

2. The jewelry box of claim 1, further comprising a connecting wall protruding from the inner surface of the elongate member and connecting each of the opposing walls to one another to define a chamber having an open end adjacent to the jewelry-receiving member; wherein the chamber receives the jewelry-receiving member therein in the closed position.

3. The jewelry box of claim 1, wherein a portion of the second end of the elongate member, in the closed position, is seated on a top surface of the pair of opposing walls.

4. The jewelry box of claim 1, wherein the first fold is proximate a first end of each of the pair of opposing walls, and the second fold is spaced a distance apart from the first fold at a position at which a portion of the first end is foldable onto a portion of the second end or onto a top surface of the pair of opposing walls.

5. The jewelry box of claim 1, wherein the third fold is proximate a second end of each of the pair of opposing walls, and the fourth fold is spaced a distance apart from the third fold, thereby defining a first side portion of the second end that in the closed position closes an opening between the second ends of the pair of opposing walls.

6. The jewelry box of claim 1, wherein the first end and the second end of the elongate member are releasably mateable to one another in the closed position.

7. The jewelry box of claim 6, wherein the first end has a first fastening member and the second end has a second fastening member positioned to mate in the closed position.

8. The jewelry box of claim 1, wherein whichever of the first end and the second end of the elongate member forms the outermost surface of the box has a polygonal-shape.

9. A jewelry box for holding jewelry comprising:

an elongate member having a first end and a second end, an inner surface and an outer surface, and being foldable between an open position and a closed position, the closed position being a box; and a jewelry-receiving member protruding from the inner surface of the elongate member for movement therewith, the jewelry-receiving member defining a receptacle to receive a piece of jewelry; and a pair of opposing walls extending from the elongate member, the pair of opposing walls being spaced apart a distance from one another and oriented relative to the jewelry-receiving member to have or receive the jewelry-receiving member therebetween in the closed position;

wherein:

the receptacle, in the open position, is oriented generally perpendicular to the inner surface of the elongate member and, in the closed position, after rotation of the j ewelry-receiving member of about 90 degrees, the receptacle is oriented generally parallel to the inner surface of the elongate member; and the first end of the elongate member has a first fold, a second fold, and a third fold, and the second end of the elongate member has a fourth fold, wherein the first fold, second fold, third fold, and fourth fold are oriented transverse to a central longitudinal axis of the elongate member.

10. The jewelry box of claim 9, wherein the first fold is adjacent to a first end of each of the opposing walls, the second fold is spaced a distance apart from the first fold, and the third fold is spaced a distance apart from the second fold at positions aligned with opposing corner planes of the top surface of the pair of opposing walls; and wherein the fourth fold is adjacent to a second end of each of the pair of opposing walls.

11. The jewelry box of claim 9, wherein the jewelry-receiving member is between the first fold and the second fold.

12. The jewelry box of claim 9, wherein the jewelry-receiving member is adjacent to the fourth fold.

* * * * *